US007610720B2

(12) United States Patent
Kirejczyk et al.

(10) Patent No.: US 7,610,720 B2
(45) Date of Patent: Nov. 3, 2009

(54) RAILLESS WINDOW REGULATOR

(75) Inventors: Juliusz Kirejczyk, Newmarket (CA); Ed Fortin, Newmarket (CA)

(73) Assignee: MaGna Closures Inc, Newmarket Ontario (CA)

( * ) Notice: Subject to any disclaimer, the term of this patent is extended or adjusted under 35 U.S.C. 154(b) by 382 days.

(21) Appl. No.: 11/411,722

(22) Filed: Apr. 26, 2006

(65) Prior Publication Data

US 2007/0251149 A1 Nov. 1, 2007

(51) Int. Cl.
*E05F 11/48* (2006.01)

(52) U.S. Cl. ..... 49/352; 49/349; 49/502

(58) Field of Classification Search ..... 49/348, 49/349, 352, 374, 375, 502, 506
See application file for complete search history.

(56) References Cited

U.S. PATENT DOCUMENTS

| | | | | |
|---|---|---|---|---|
| 3,890,743 | A * | 6/1975 | Eckhardt et al. | 49/352 |
| 4,109,417 | A | 8/1978 | Fogarollo | |
| 4,110,935 | A * | 9/1978 | Sessa | 49/352 |
| 4,805,346 | A | 2/1989 | Gergoe | |
| 4,970,827 | A * | 11/1990 | Djordjevic | 49/349 |
| 5,001,867 | A * | 3/1991 | Dupuy | 49/502 |
| 5,067,281 | A * | 11/1991 | Dupuy | 49/502 |
| 5,174,066 | A * | 12/1992 | Dupuy | 49/502 |
| 5,469,662 | A | 11/1995 | TenBrink et al. | |
| 5,477,641 | A | 12/1995 | Heckel et al. | |
| 6,354,652 | B1 | 3/2002 | Arquevaux et al. | |
| 6,397,524 | B1 | 6/2002 | Sakaguchi et al. | |
| 6,510,657 | B1 | 1/2003 | Bertolini et al. | |
| 6,546,672 | B2 * | 4/2003 | Tatsumi et al. | 49/352 |
| 6,688,043 | B1 | 2/2004 | Feder et al. | |
| 6,820,370 | B2 | 11/2004 | Marscholl | |
| 2002/0083647 | A1 | 7/2002 | Bostian et al. | |
| 2004/0163320 | A1 | 8/2004 | Kirejczyk | |

FOREIGN PATENT DOCUMENTS

| | | |
|---|---|---|
| DE | 1 630 609 | 3/1970 |
| EP | 0 389 873 A2 | 10/1990 |
| FR | 2768765 | 3/1999 |
| WO | WO 99/59833 | 11/1999 |

OTHER PUBLICATIONS

English Abstract of FR 2768765.

* cited by examiner

*Primary Examiner*—Katherine W Mitchell
*Assistant Examiner*—Michael J Keller
(74) *Attorney, Agent, or Firm*—Clark Hill PC

(57) ABSTRACT

A cable window regulator assembly is mounted to a carrier panel. At least four pulleys are spaced around the carrier panel, each rotating around an axis substantially perpendicular to the carrier panel. A lift plate assembly is displaced away from the carrier panel and is constrained to travel in a closure plane solely by the closure panel. An upper and a lower cable is trained around a first pair of the pulleys. One end of each of the upper and lower cables is affixed to a drive assembly; the other end of the upper and lower cables is affixed to the lift plate assembly on opposite sides near opposing edges of the lift plate assembly. Engaging the drive assembly causes the lift plate assembly to move towards either an open or a closed position. A follower cable, affixed to the lift plate assembly at opposite sides thereof and trained about a second pair of the pulleys, maintains coordinated travel of the lift plate assembly.

17 Claims, 5 Drawing Sheets

RAILLESS WINDOW REGULATOR

FIELD OF THE INVENTION

This invention relates generally to window regulators for motor vehicles. More specifically, the invention relates to railless window regulators.

BACKGROUND OF THE INVENTION

Conventional cable window regulators typically include either a single rail or a pair of rails bolted to a carrier panel mounted within a doorframe. A lift plate is slidably attached to each rail, which in turn holds a window glass. A cable is attached to the top and bottom of each lift plate, and routed around pulleys located around the two ends of the rail. The cable is wound around a cable drum, which is rotated by either a power motor or a hand crank. By engaging the motor, the lift plates can be raised or lowered along the rails between an open and a closed position (i.e., the distance required to move the window between its fully open and closed positions).

Conventional cable window lift systems tend to be vehicle specific. As the window glass moves with the lift plate, and as window glass in automobiles is typically curved, each rail must have a curvature corresponding to the glass and this will vary from vehicle to vehicle and from window to window within a given vehicle. Furthermore, the overall length of the rails is also a concern as the vertical height available within a doorframe is limited in space. A conventional cable window lift system requires an overall height of approximately that of the range of travel required for the lift plates, plus the space required to mount the top and bottom pulleys. The range of travel of the lift plates provided by the window regulator is typically limited to the distance between the pulleys. Any attempt at further travel will result in the lift plate striking either the top or bottom pulley.

US patent application 2004/0163310 to Kirejczyk teaches a rail-less window regulator. A cable window regulator is provided which comprises a first pulley rotatably mounted to a first pulley bracket and a second pulley rotatably mounted to a second pulley bracket. The regulator further comprises a lift plate securable to a window glass, a cable affixed at opposite ends thereof to the lift plate and running over the first and second pulleys. A window regulator drive assembly is operably connected to the cable for causing movement of the cable and in turn moving lift plate relative to the first and second pulleys. The first pulley bracket, second pulley bracket and window regulator drive assembly are mountable to a structure housing, and no rails are used.

By eliminating the need for rails, this cable window regulator simplifies door assembly. In addition, the range of travel of the lift plates spans a distance greater than the distance between the first and second pulleys. However, the rail-less window regulator is not without its own drawbacks. By placing the pulley axes parallel to and spaced apart from the closure pane, the overall thickness of the carrier panel is increased in a doorframe where space is at a premium. In addition, pulley brackets are required, increasing the parts and assembly costs of the window regulator.

SUMMARY OF THE INVENTION

It is an object of the invention to provide a cable window regulator that simplifies door assembly. It is an additional object of the invention to provide a cable window regulator that minimizes the thickness of the cable window regulator. It is an additional object of the invention to provide a cable window regulator that provides a range of travel for the lift plate assembly that is greater than the distance between the upper and lower pulleys. It is also an additional object of the invention to provide greater stability for a mounted window glass without requiring the use of rails.

A cable window regulator assembly comprising:

a carrier panel;

a pair of pulleys, each pulley of the pair of pulleys rotatably mounted to the carrier panel around a pulley axis generally transverse to the carrier panel;

a lift plate assembly securable to a closure panel and is constrained to travel in a closure plane solely by the closure panel;

at least one cable affixed to the lift plate assembly and trained about the first and second pulleys; and a window regulator drive assembly operably connected to the at least one cable for causing movement of the lift plate assembly and effecting travel of the closure panel.

DESCRIPTION OF DRAWINGS

Preferred embodiments of the present invention are described in detail below with reference to the accompanying illustrations in which.

DESCRIPTION OF PREFERRED EMBODIMENTS

Figure 1:
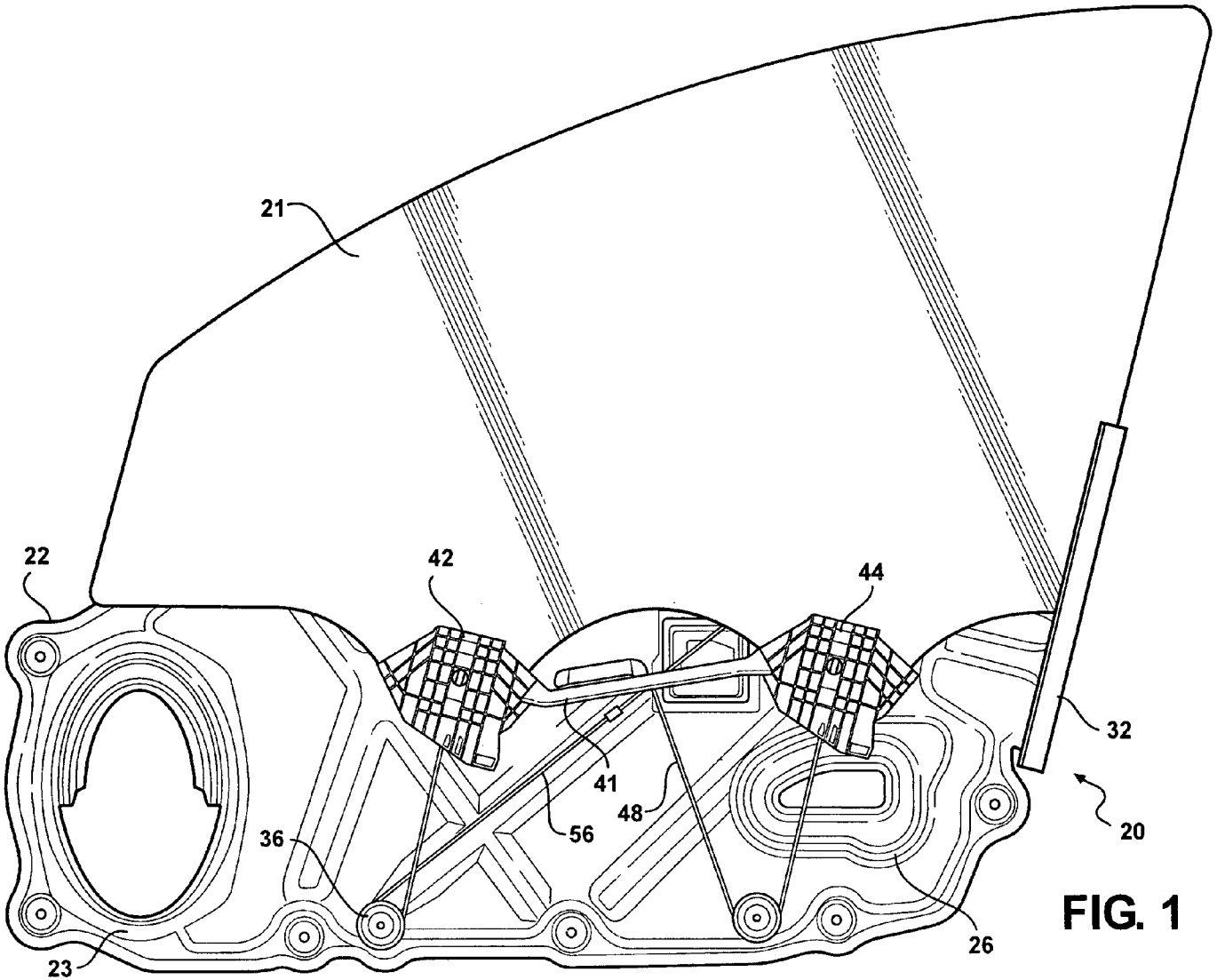
FIG. 1 shows a side profile view of a cable window regulator with a mounted window glass in accordance with a first embodiment of the invention.
Figure 2:
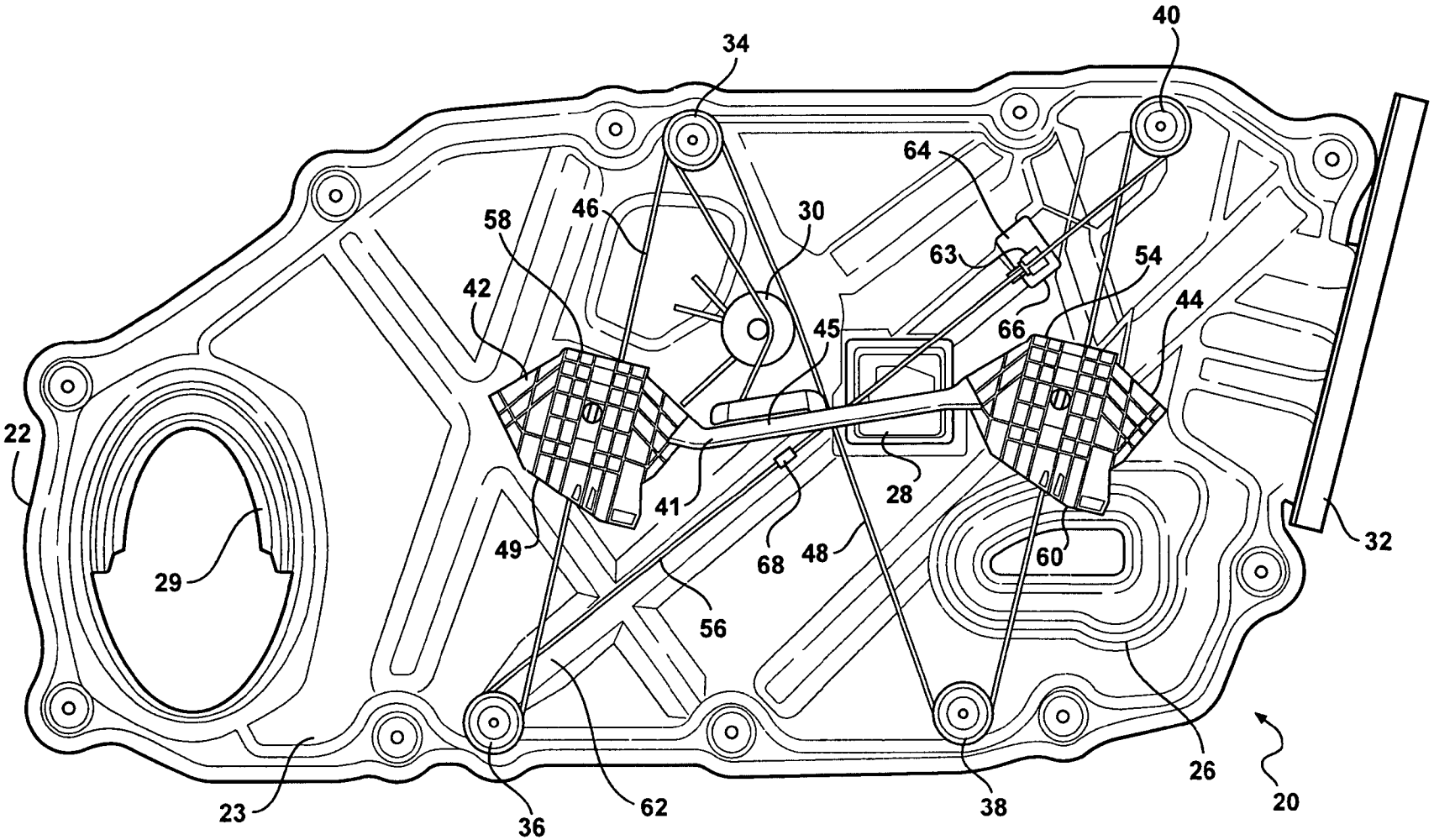
FIG. 2 shows a side profile view of the cable window regulator shown in FIG. 1 with the window glass removed.
Figure 3:
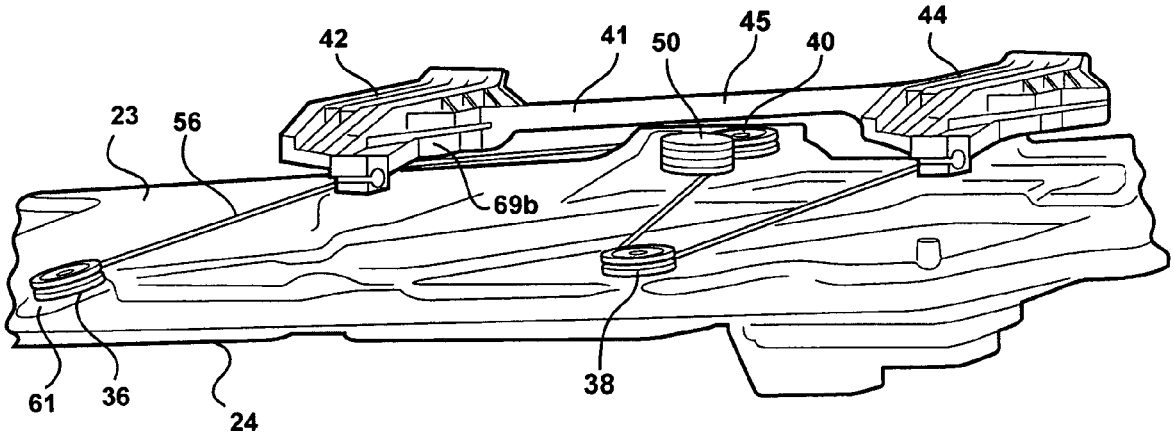
FIG. 3 shows a perspective view of a portion of the exterior-facing surface on the cable window regulator shown in FIG. 2.

Referring now to FIGS. 1 and 2, a window regulator 20 operable to transport a window glass 21 or other closure panel between an open (i.e., the door window is open) and a closed position (i.e., the door window is closed) is shown. FIG. 1 shows window glass 21 located approximately midway between the open and closed positions, and FIG. 2 shows window regulator 20 with window glass 21 removed. Window regulator 20 is incorporated onto a carrier panel 22. Carrier panel 22 is affixed to a vehicle door frame (not shown). The carrier panel 22 includes an exterior-facing surface 23 and an interior-facing surface 24 (FIG. 3). As is well known in the art, carrier panel 22 acts as an equipment module, carrying a variety of the door components and may be a sealed hardware carrier, non-sealed hardware carrier, trim panel, etc. The carrier panel 22 is preferably molded from an organic plastic material and can include a number of different integrally molded accessories mounted to surfaces 23 24, such as crumple impact zone 26, arm rest mount 28, speaker housing 29 cable drum housing 30, and integral glass guide 32. Other accessories will occur to those of skill in the art.

Four pulleys 34, 36, 38 and 40 are rotatably mounted to carrier panel 22, each around an axis that is substantially perpendicular to window glass 21. As is described in greater detail below, pulleys 34 and 38 form a first pair of pulleys and pulleys 36 and 40 form a second pair of pulleys. Pulleys 34, 36, 38 and 40 are spaced apart as to generally form a parallelogram. The spaced arrangements and pairings of pulleys 34, 36, 38 and 40 are not particularly limited, and other numbers, pairings and spaced arrangements of pulleys are possible. Generally speaking, the distance between pulleys 34 and 36 measured along the glass travel path is the same as the distance between pulleys 38 and 40. Those skilled in the art will understand that pulleys 34, 36, 38 and 40 could be replaced by arcuate non-rotating sliding surfaces. The arcuate sliding surfaces are commonly utilized in the window regulating industry to replace pulleys. Alternatively, the sliding surface could be molded directly from carrier panel 22 at the desired angles.

A lift plate assembly 41, adapted to carry a closure panel, typically window glass 21, along a closure plane between the open position and closed positions over exterior-facing surface 23. As can clearly be seen in FIG. 3, and described in greater detail below, lift plate assembly 41 is generally not in contact with carrier panel 22 during regulator operations. In the presently illustrated embodiment, lift plate assembly 41 comprises a pair of lift plates 42 and 44, connected by a cross-strut 45. Lift plate 41 can be a unitary construction, or it can be assembled from separately molded lift plates and cross strut parts. Alternatively, lift plate assembly 41 can comprise independent lift plates 42 and 44 that are not interconnected by a cross-strut 45. Lift plate 42 moves over pulleys 34 and 36, along a path determined by the window glass' movement direction. The axes of pulleys 34 and 36 are distributed on opposing sides of the centerline of lift plate 42, proximate its open and closed positions, respectively. Lift plate 44 moves over pulleys 38 and 40, along a path determined by the window glass' movement direction. The axes of pulleys 38 and 40 are distributed on opposing sides of the centerline of lift plate 44, proximate its open and closed positions. In the current embodiment, pulleys 34 and 38 are located between the centerlines of the two lift plates, and pulleys 36 and 40 are located outside of the centerlines of the two lift plates. However, locating pulleys 34 and 40 on the outside, and pulleys 36 and 38 on the inside of the centerlines is also within the scope of the invention. As is described in greater detail below, the range of travel of lift plates 42 and 44 extend beyond the distance between pulleys 34 to 36 and 38 to 40.

Window regulator 20 uses at least one cable to raise and lower lift plates 42 and 44, and a follower cable to help stabilize the lift plates 42 and 44. Preferably, the at least one cable is a pair of cables, namely upper cable 46 and lower cable 48, that cooperatively motivate the lift plate assembly around a first pair of pulleys. Upper cable 46 is routed around pulley 34 and is attached at one end to lift plate 42 proximate an edge 49 and at the other end to a cable drum 50 located within cable drum housing 30. A lower cable 48 is routed around pulley 38 and is attached at one end to second lift plate 44 proximate an edge 54 and at the other end to cable drum 50. While it is presently preferred that separate cables be used for upper cable 46 and lower cable 48, it is contemplated that a single cable wrapped around cable drum 50, and attached at one end to lift plate 42 approximate an edge 49 and at the other end to lift plate 44 proximate an edge 54. A follower cable, namely middle cable 56 is routed around a second pair of pulleys, namely pulleys 36 and 40 and is connected at one end to lift plate 42 proximate an edge 58 and at the other end to second lift plate 44 proximate an edge 60.

Cable drum 50 is drivingly mounted to a drive assembly (not shown) mounted on the interior-facing surface 24 of carrier panel 22. The drive assembly can be a reversible power motor or actuator or a manual crank assembly. Depending on the direction of rotation, engaging the drive assembly rotates cable drum 50, causing lift plate 42 to move towards its open position or causes second lift plate 44 to move towards its closed position. Since middle cable 56 is attached to the opposite side of the leading lift plate, it moves the other lift plate in tandem with the leading lift plate. While the embodiment illustrated here shows cable drum 50 being operably connected to upper and lower cables 46 and 48 between the four pulleys 34 to 40, it will be apparent to those of skill in the art, that cable drum 50 can be located outside of the four pulleys. Thus, in the presently illustrated embodiment of the invention, lower cable 48 and middle cable 56 intersect approximately midway between the four pulleys. However, those of skill in the art will recognize that the point of intersection can vary. Preferably, molded cable guide 62 is provided on exterior-facing surface 23 to help route middle cable 56. However, upper cable 46 and lower cable 48 can also be located within cable guide 62 to increase clearance between intersecting portions of cable. Preferably, each of the pulleys is offset from the lift path by the minimum amount possible to reduce undesired torque.

Referring now to FIG. 3, a portion of exterior-facing surface 23 is shown in greater detail. Although pulleys 34, 36, 38 and 40 are mounted around an axis substantially perpendicular to window glass 21, it has been found advantageous to tilt the axis at least two of the pulleys so that their axes are not parallel. Each pulley has been mounted to an angled region 61 of carrier panel 22. By angling the pulleys relative to each other, greater clearance is proved between intersecting portions of cable. Depending on the arrangement of the pulleys and the curvature of carrier panel 22, not every pulley needs to be mounted on an angled region 61. For example, pulleys 36 and 40 could be mounted to an angled region 61, while pulleys 34 and 38 would not be.

Figure 4:
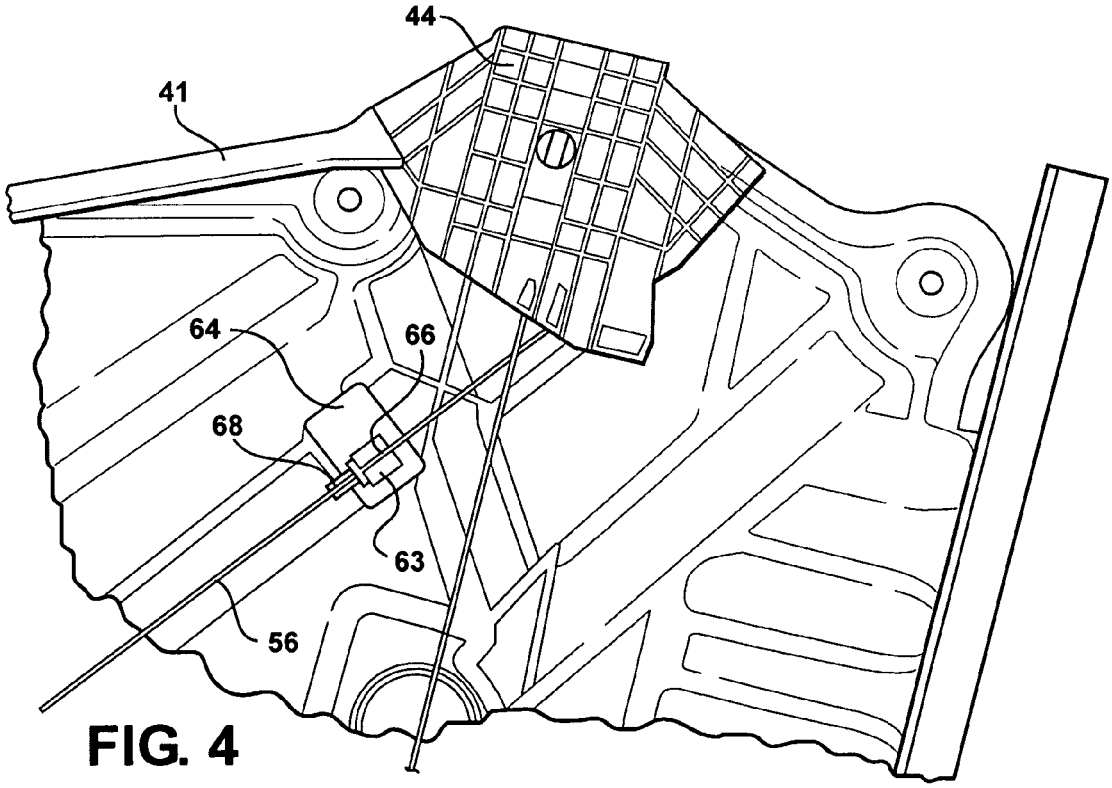
FIG. 4 shows a side profile view of a stop bushing mounted to one of the cables engaging a stop bumper on a carrier panel of the cable window regulator shown in FIG. 2.

Referring now to FIG. 4, a stop bumper 63 is retained within a bumper housing 64 integrally formed from carrier panel 22. Preferably, bumper housing 64 is located somewhat near pulley 40 though clear of the travel of lift plate 44. Stop bumper 63 includes an aperture 66 that middle cable 56 is threaded through. Aperture 66 is sized larger than middle cable 56 so that the movement of the cable is not unduly impeded. A resilient bushing 68 is coaxially mounted over middle cable 56 in a tight friction fit, so that bushing 68 moves in tandem with middle cable 56. As shown in FIG. 4, when the lift plates 42 and 44 reach their open position (i.e., the window is open), resilient bushing 68 abuts against stop bumper 63, preventing further travel of lift gates 42 and 44, and minimizing shock to window glass 21.

Figure 5:
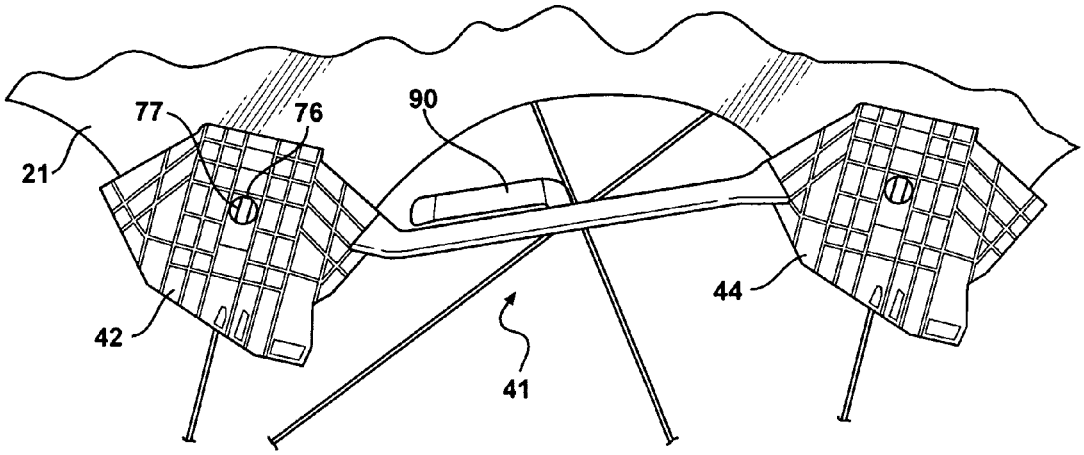
FIGS. 5 and 6 show opposing sides of a lift plate assembly attached to the cable window regulator shown in FIG. 2.
Figure 6:
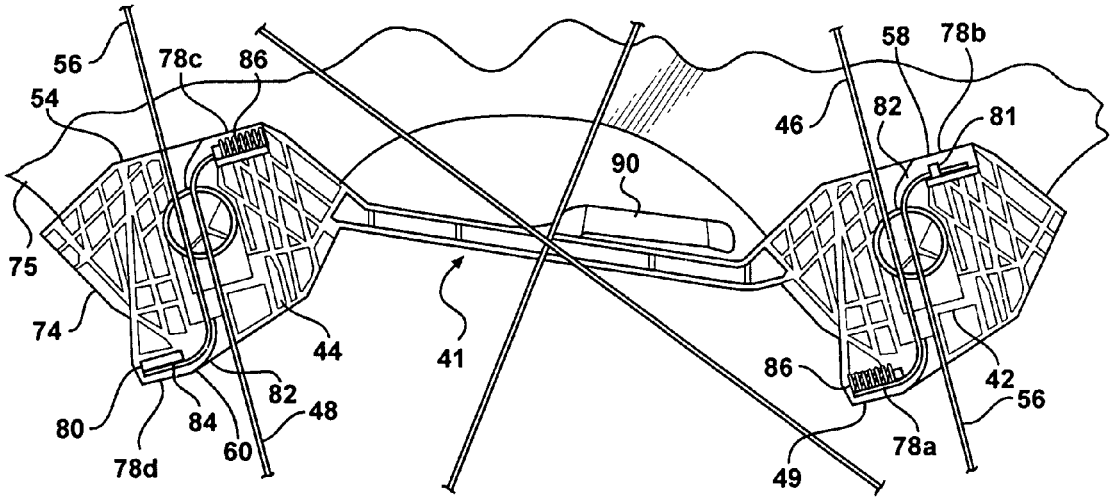
Figure 7:
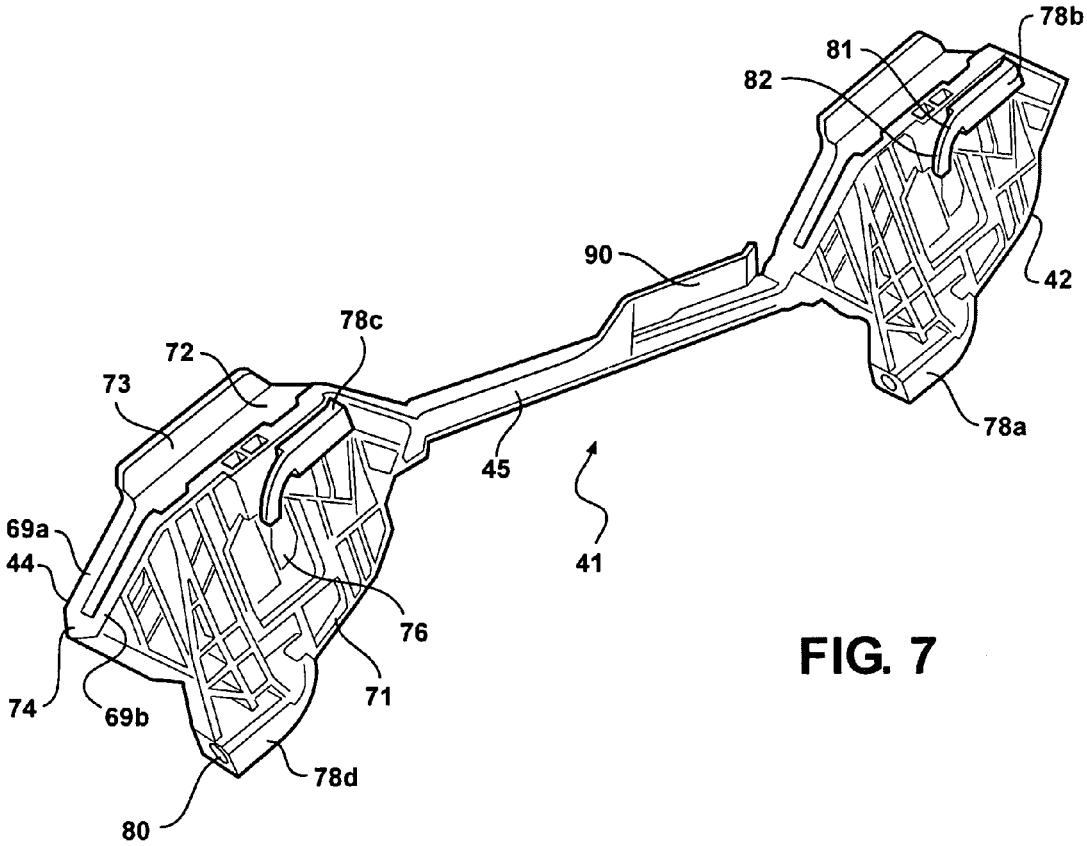
FIG. 7 shows an isolated perspective view of the lift plate assembly shown in FIGS. 5 and 6.

Referring now to FIGS. 5, 6 and 7, lift plate assembly 41 is shown in greater detail. FIG. 5 shows the exterior-facing side of lift plate assembly 41 and FIG. 6 shows the interior-facing side of lift plate assembly 41 (i.e., facing towards carrier panel 22). FIG. 7 shows a perspective view of lift plate assembly 41, with window glass 21 removed. Lift plates 42 and 44 each comprise two wall portions 69*a* and 69*b* spaced apart as to guide window glass 21. The two wall portions 69 are interconnected by a base 71, and forming a channel 72 therebetween. Wall portion 69*a* includes a curved guidance surface 73 operable to assist in the insertion of window glass 21 into channel 72 at a preferred angle. Base 71 includes a pair of angled sidewalls portions 74 that extend out at approximately 45° from the travel directions of the lift plate. Window glass 21 includes an angled mounting region 75 that is complementary to angled sidewall portions 74 that is inserted into channel 72. Angled sidewall portions 74 provide additional glass stability, both when mounting window glass 21 glass to the lift plate and during regular operation of window regulator 20. A snap-in coupler 76 extending from one of the wall portions 69 enters an aperture 77 in mounting region 75 of the window glass 21 to lock the window glass in place. In the presently illustrated embodiment, lift plate 42 is symmetrical to lift plate 44.

Cable and spring housings 78 are provided on the wall portions 69*b* of both lift plates 42 and 44 to secure the ends of cables 46, 48 and 56. On lift plate 42, one end of upper cable 46 is affixed to housing 78*a*, and one end of middle cable 56 is affixed to housing 78*b*. On lift plate 44, one end of lower cable 48 is affixed to housing 78*c* and one end of middle cable 56 is affixed to housing 78*d*. Cables 46, 48 and 56 run along the length of wall portion 69*b* before terminating within their designated housing 78. Thus, upper cable 46 terminates at one end in housing 78*a* proximate edge 49 on lift plate 42, and lower cable 48 terminates at one end in housing 78*c* proximate edge 54 on lift plate 44 (FIG. 2). Middle cable 56 terminates at one end in housing 78*b* proximate edge 58 on lift plate 42 and terminates at the other end in housing 78*d* proximate edge 60 on lift plate 44 (FIG. 2).

As is best seen in FIG. 3, lift plate assembly 41 move along the closure plane, and away from exterior-facing surface 23. Wall portions 69*b* are displaced far enough away from carrier panel 22 so that they can move over the pulleys with minimum clearance. Housings 78 are preferably at a similar height away from carrier panel 22 as are pulleys 34-40. Thus, when lift plate assembly 41 reaches the glass closed position, pulleys 34 and 40 are adjacent to housings 78*a* and 78*d* respectively. When lift plate assembly 41 reaches the glass open position, pulleys 36 and 38 are adjacent to housings 78*b* and 78*c* respectively. It will now become apparent that the placement of housings 78 along the furthest edge of lift plates 42 and 44 allows the range of travel of lift plate assembly 41 to be extended past the distance between pulleys by a significant portion of the space between housings.

Each housing 78 is aligned generally traverse to the direction of travel of lift plate assembly 41 as to extend the range of travel and minimize the size of lift plates 42 and 44. In the presently-preferred embodiment, housings 78 are generally perpendicular to the direction of travel. Each housing 78 includes an opening 80 at the end of the housing nearest the end of the upper cable 46, lower cable 48 and middle cable 56, and a narrower second opening 81 at the other end of housing 78. A ramp portion 82 is provided for each housing 78 to help guide the upper, lower and middle cables 46, 48 and 52 around their respective turns and through opening 80. A cable end 84 is attached to the ends of each of upper cable 46, lower cable 48, and middle cable 56, and sized as to fit through opening 80 but not to exit through opening 81, thereby retaining the end of the cable within housings 78. Cable end 84 retain the cable ends within the four housings 78. A helical spring 86 is coiled around the cable ends 84 within housings 78*a* and 78*c* on upper cable 46 and lower cable 48 respectively, in order to provide cable tension and smoother motion for lift plate assembly 41 when the drive assembly engages.

Figure 8:
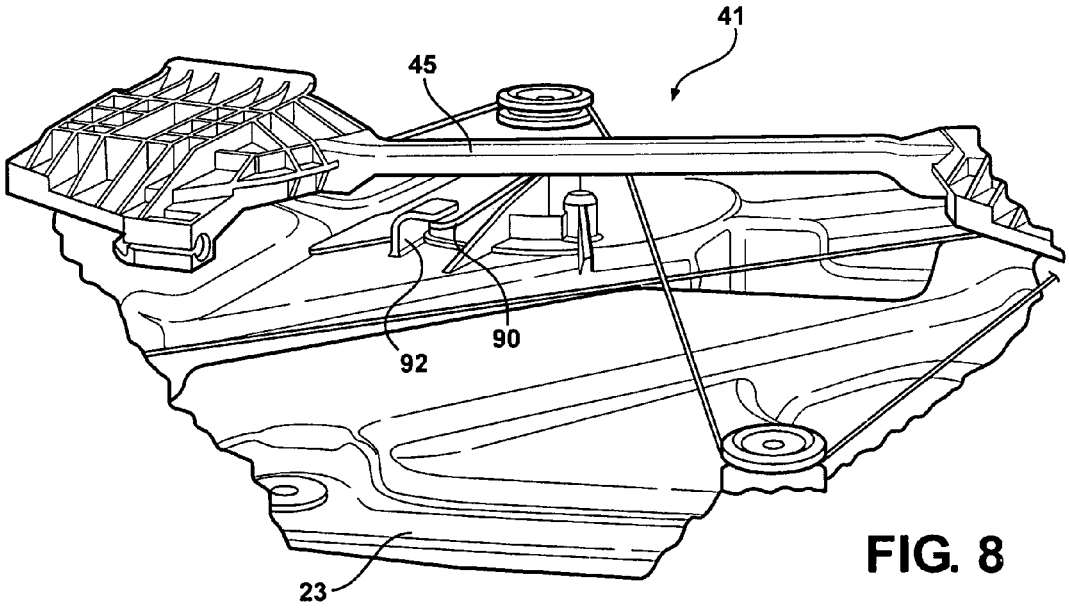
FIG. 8 shows a perspective view of a portion of the cable window regulator shown in FIG. 2, featuring a mounting hook used to assist in mounting a window glass.

A flexible L-shaped mounting finger 90 extends outwards from cross-strut 45. Mounting finger 90 is generally flat and is parallel to the closure plane. However, during assembly of window regulator 20, mounting finger 90 is bent towards exterior-facing surface 23 and retained within a hook 92 that is integrally formed on carrier panel 22, so that the lift plate assembly 41 abuts against it (FIG. 8). Channel 72 remains correctly aligned for insertion of window glass 21 Hook 92 is aligned as to restrict mounting finger 90 from moving away from exterior-facing surface 23, but does not prevent it from moving towards either the open or the closed position. During the glass insertion process, lift plate assembly 41 is moved away by the window glass 21 from exterior-facing surface 23 to create a minimum clearance to the carrier 22. When the drive assembly (not shown) is engaged to move window glass 21, mounting finger 90 is displaced away from hook 92 and returns to its flat shape. Motion of window glass 21 along the closure plane causes lift plate assembly 41 to be displaced away from the surface of carrier panel 22. Since mounting finger 90 has returned to its natural shape, hook 92 does not interfere with the motion of lift plate assembly 41 along the closure plane. While FIG. 8 illustrates an L-shaped mounting finger 90 to retain lift plate assembly 41 temporarily against carrier panel 22 during assembly, it will be apparent to those of skill in the art that other flexible retaining devices are also within the scope of the invention. For instance, an elastic band could be hooked around tabs on lift plate assembly 41 and on carrier panel 22. By moving lift plate assembly 41 along the closure plane, the elastic band would be released from the hooks.

What is claimed is:

1. A cable window regulator assembly comprising:

a carrier panel;

a first pair of pulleys, each pulley of the first pair of pulleys rotatably mounted to the carrier panel around a pulley axis generally transverse to the carrier panel;

a lift plate assembly securable to a closure panel and constrained to travel in a closure plane solely by the closure panel;

at least one cable trained about one of the first pair of pulleys and affixed to the lift plate assembly at an angle transverse to the direction of travel of the lift plate assembly;

a window regulator drive assembly operably connected to the at least one cable for causing movement of the lift plate assembly and effecting travel of the closure panel; and a temporary latching device operable to cause the lift plate to abut against the surface of the carrier panel, thereby aligning a channel in the lift plate with a preferred angle of glass insertion, and where engaging the drive assembly moves the lift plate assembly and further disengages the temporary latching device so that the lift plate assembly moves away from the surface of the carrier panel and into the closure plane.

2. The cable window regulator assembly of claim 1, further comprising:

a second pair of pulleys, each pulley of the second pair of pulleys rotatably mounted to the carrier panel around a pulley axis generally transverse to the carrier panel and that each pulley of the first and second pairs of pulleys are spaced relative to each other in a generally rectangular configuration;

the at least one cable being affixed at each end to the lift plate assembly on opposite sides near opposing edges of the lift plate assembly; and a follower cable affixed to the lift plate assembly at opposite sides thereof and trained about the second pair of the pulleys to maintain coordinated travel of the lift plate assembly.

3. The cable window regulator of claim 1, wherein the at least one cable includes an upper cable attached at one end to the lift plate assembly and at the other end to the window regulator drive assembly and a lower cable attached at one end to the lift plate assembly and at the other end to the window regulator drive assembly.

4. The cable window regulator of claim 1, wherein the lift plate assembly comprises two spaced-apart lift plates, each lift plate operable to secure a portion of the closure panel.

5. The cable window regulator of claim 4, wherein the two spaced-apart lift plates are connected by a cross-strut.

6. The cable window regulator of claim 1, wherein the lift plate assembly comprises a single lift plate that includes at least two contact points to secure the closure panel.

7. The cable window regulator of claim 3, wherein an end of each of the upper and lower cables leaves contact with the lift plate assembly proximate the furthest edge of the lift plate assembly relative to the pulley of the first pair of pulleys routing that cable of the upper and lower cables.

8. The cable window regulator of claim 2, wherein the ends of the follower cable leave contact with the lift plate assembly proximate the furthest edge of the lift plate assembly relative to the second pair of pulleys routing the follower cable.

9. The cable window regulator of claim 2, wherein the axis of rotation of at least one pulley of the first and second pairs of pulleys is angled non-parallel to the axis of rotation of at least one other pulley of the first and second pairs of pulleys, thereby spacing intersecting portions of any of the at least one cable, and the follower cables.

10. The cable window regulator of claim 2, wherein the drive assembly is mounted to the carrier panel between the first and second pairs of pulleys.

11. The cable window regulator of claim 2, wherein the drive assembly is mounted outside of the first and second pairs of pulleys.

12. The cable window regulator of claim 2, wherein the carrier panel provides guiding surfaces to bend portions of the upper cable, the lower cable and the follower cable transverse to the direction of travel of the lift plate assembly.

13. The cable window regulator of claim 1, wherein the carrier panel provides a guiding surface along at least one edge of the window glass in order to reduce shaking of the window glass.

14. The cable window regulator of claim 1, wherein the lift plate assembly provides at least one snap-in mount for the window glass.

15. The cable window regulator of claim 2, further comprising:

a bushing, mounted to one of the at least one cable and the follower cable and operable to move in tandem with the follower cable;

a bumper, extending out from the carrier plate; and wherein the bushing abuts against the bumper when the lift plate assembly is in its open position, thereby preventing further travel of the lift plate assembly in its current direction.

16. The lift plate assembly of claim 1, wherein the temporary latching device comprises a flexible mounting finger extending out from the lift plate assembly and bent to engage a complementary hook extending from the carrier panel so that the lift plate assembly abuts against the surface of the carrier panel and where moving the lift plate assembly causes the flexible mounting finger to disengage from the hook and straighten.

17. A cable window regulator assembly comprising:

a carrier panel;

a first pair of pulleys, each pulley of the first pair of pulleys rotatably mounted to the carrier panel;

a lift plate assembly securable to a closure panel and is constrained to travel in a closure plane solely by the closure panel;

at least one cable trained about one of the first pair of pulleys and affixed to the lift plate assembly;

a window regulator drive assembly operably connected to the at least one cable for causing movement of the lift plate assembly and effecting travel of the closure panel; and a temporary latching device operable to cause the lift plate assembly to abut against the surface of the carrier panel, thereby aligning a channel in the lift plate assembly with a preferred angle of glass insertion, and where engaging the drive assembly moves the lift plate assembly and further disengages the temporary latching device so that the lift plate assembly moves away from the surface of the carrier panel and into the closure plane.

* * * * *